US005816375A

United States Patent [19]

Tu

[11] Patent Number: 5,816,375

[45] Date of Patent: Oct. 6, 1998

[54] RETRACTABLE HANDLE CONTROL SYSTEM

[76] Inventor: A-Shih Tu, No. 61, 32rd Rd., Industrial Areaof Taichung City, Taiwan

[21] Appl. No.: 955,814

[22] Filed: Oct. 22, 1997

[51] Int. Cl.[6] ..... A45C 13/00

[52] U.S. Cl. ..... 190/115; 190/39; 16/115

[58] Field of Search ..... 190/39, 115; 16/110 R, 16/115

[56] References Cited

U.S. PATENT DOCUMENTS

| | | | |
|---|---|---|---|
| 5,542,150 | 8/1996 | Tu | 16/115 |
| 5,613,273 | 3/1997 | Tsai | 190/115 X |
| 5,624,012 | 4/1997 | Wang | 190/115 |

*Primary Examiner*—Allan N. Shoap
*Assistant Examiner*—Tri M. Mai
*Attorney, Agent, or Firm*—Rosenberg, Klein & Bilker

[57] ABSTRACT

A retractable hand control system including a control unit fixedly mounted on a travel bag and coupled to a retractable handle unit in the travel bag, and a hand grip unit coupled to the retractable handle unit and controlled to move sliding tubes of the retractable handle unit in and out of the travel bag, wherein the control unit has a control knob controlled to release the hand grip unit for operation, and spring means which pushes the hand grip unit out of the travel bag for operation when the hand grip is released; the hand grip unit has a pressure bar controlled to unlock the retractable handle unit, for permitting sliding tubes of the retractable handle unit to be moved to an extended position.

1 Claim, 5 Drawing Sheets

RETRACTABLE HANDLE CONTROL SYSTEM

BACKGROUND OF THE INVENTION

The present invention relates to a retractable handle control system for travel bags, and more particularly to such a retractable handle control system in which the hand grip unit is received inside a casing of a control unit within the travel bag, and pushed out of the casing and the travel bag for operation by spring means when a control knob on the casing is depressed.

A retractable handle of a travel bag is generally comprised of two sleeves, two sliding tubes moved in and out of the sleeves, a hand grip transversely connected between the sliding tubes outside the sleeves, and lock means adapted to lock the sliding tubes in an extended position or a retracted position. This structure of retractable handle is still not satisfactory in function. Because the hand grip is exposed to the outside for operation by hand, it tends to be damaged. Further, the exposed hand grip destroys the sense of beauty of the travel bag.

SUMMARY OF THE INVENTION

The present invention has been accomplished to provide a retractable handle control system which eliminates the aforesaid problem. It is one object of the present invention to provide a retractable handle control system which holds the hand grip unit from sight when the retractable handle is collapsed. It is another object of the present invention to provide a retractable handle control system which is easy and inexpensive to manufacture. According to the present invention, the retractable hand control system comprises a control unit fixedly mounted on a travel bag and coupled to a retractable handle unit in the travel bag, and a hand grip unit coupled to the retractable handle unit and controlled to move sliding tubes of the retractable handle unit in and out of the travel bag, wherein the control unit has a control knob controlled to release the hand grip unit for operation, and spring means which pushes the hand grip unit out of the travel bag for operation when the hand grip is released; the hand grip unit has a pressure bar controlled to unlock the retractable handle unit, for permitting sliding tubes of the retractable handle unit to be moved to an extended position.

DETAILED DESCRIPTION OF THE PREFERRED EMBODIMENT

Figure 1:
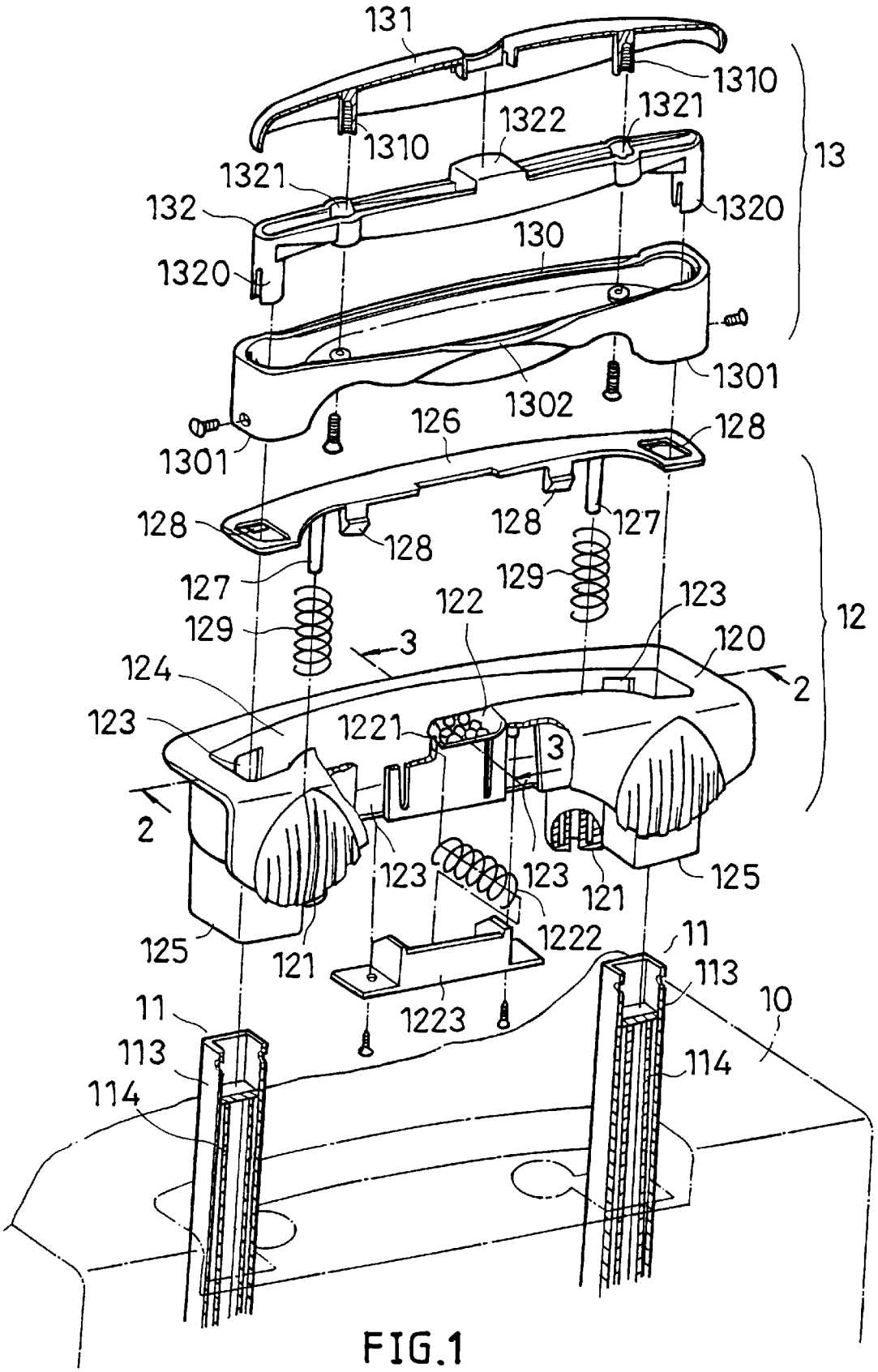
FIG. 1 is an exploded view of a retractable handle control system according to the present invention.
Figure 2:
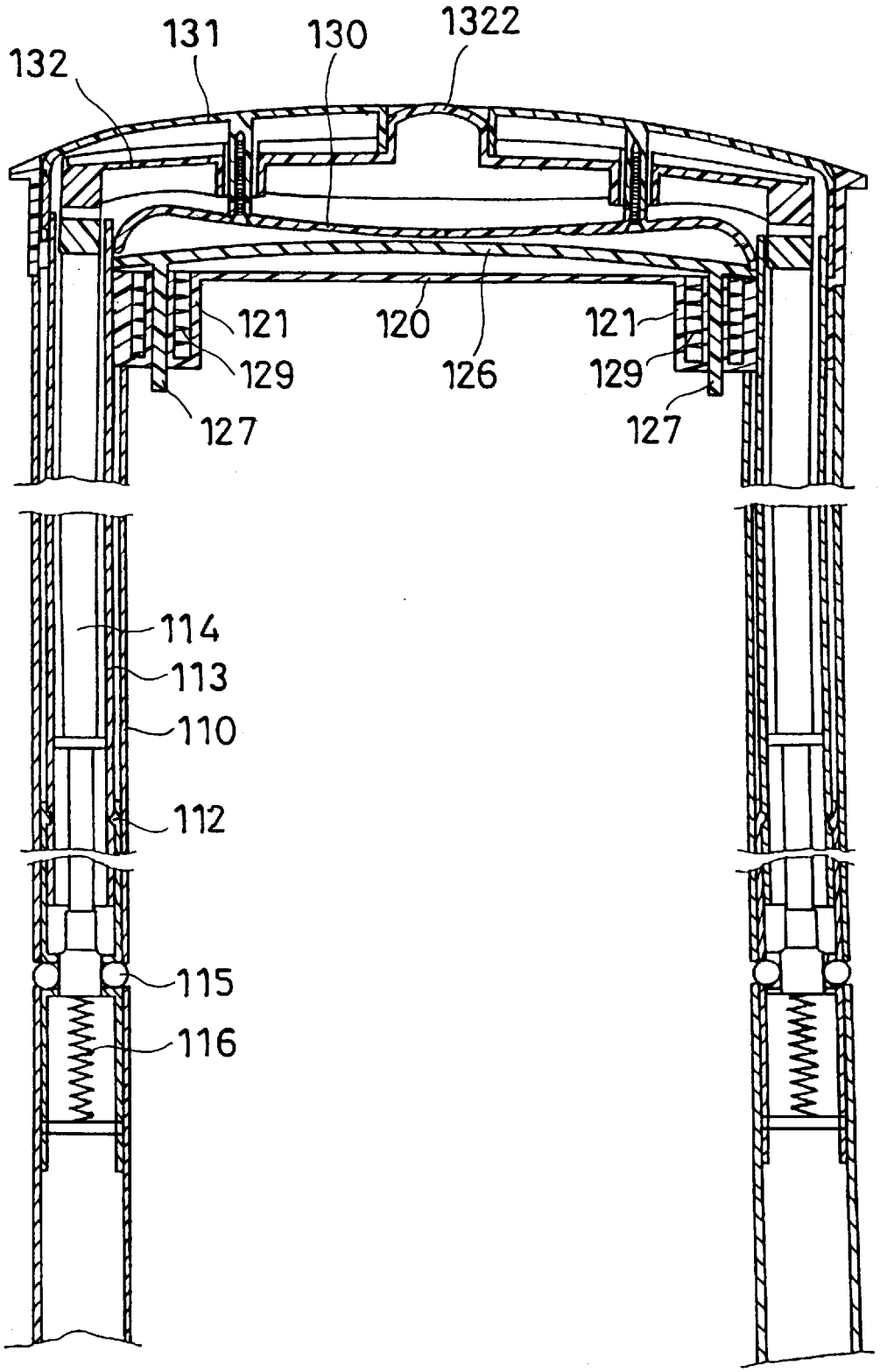
FIG. 2 is a sectional view taken along line A—A of FIG. 1.
Figure 3:
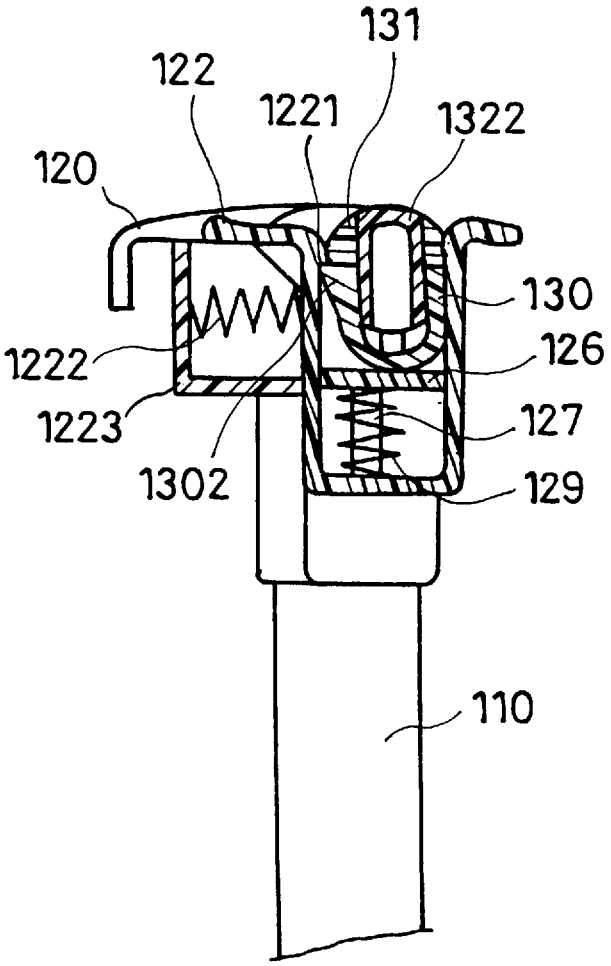
FIG. 3 is a sectional view taken along line B—B of FIG. 1.

Referring to FIGS. 1, 2 and 3, a retractable handle control system in accordance with the present invention is generally comprised of a control unit 12 fixedly mounted on a travel bag 10, a retractable handle unit 11 mounted on the travel bag 10 and coupled to the control unit 12, and a hand grip unit 13 coupled to the retractable handle unit 11 and moved in and out of the control unit 12.

The retractable handle unit 11 comprises two parallel sleeves 110 fixedly fastened to the travel bag 10, two sliding tubes 113 respectively moved in and out of the sleeves 110, two push bars 114 respectively slidably mounted in the sliding tubes 113, two sockets 112 respectively fastened to the sliding tubes 113 at the bottom within the sleeves 110, and two spring elements 116 respectively mounted inside the sleeves 110 at the bottom and imparting an upward pressure to the sockets 112. The sockets 112 are respectively provided with locating steel balls 115 adapted to engage into respective locating holes (not shown) on the sleeves 110.

The control unit 12 comprises a casing 120 transversely fixed to the travel bag 10 and coupled to the retractable handle unit 11 at the top, a movable cover plate 126, a cap 1223, a first spring 1222, and two second springs 129. The casing 120 comprises two downward stub tubes 125 adapted to receive the sliding tubes 113 of the retractable handle unit 11, two spring holders 121 respectively disposed adjacent to the downward stub tubes 125 at an inner side and adapted to hold the second springs 129, a springy, or resilient, control knob 122 on the middle and having a hooked portion 1221 adapted for hooking up the hand grip unit 13, a top open chamber 124 adapted to receive the movable cover plate 126, and a plurality of vertical sliding slots 123 spaced inside the top open chamber 124. The movable cover plate 126 comprises a plurality of downward hooks 128 respectively coupled to the vertical sliding slots 123 and adapted to limit the movement of the movable cover plate 126 vertically within the top open chamber 124, and two downward rods 127 respectively inserted into the spring holders 121 of the casing 120. The second springs 129 are respectively mounted in the spring holders 121 of the casing 120 around the downward rods 127 of the movable cover plate 126, and adapted to impart an upward pressure to the movable cover plate 126. The cap 1223 is fastened to the casing 120 at one side adjacent to the control knob 122. The first spring 1222 is stopped between the cap 1223 and the control knob 122.

The hand grip unit 13 is comprised of a hand grip shell 130, a pressure bar 132, and a cover 131. The hand grip shell 130 has two through holes 1301 at two opposite ends adapted to hold the sliding tubes 113 of the retractable handle unit 11, and a locating flange 1302 raised from its front side on the middle adapted for coupling to the hooked portion 1221 of the control knob 122 of the casing 120 of the control unit 12. The .pressure bar 132 is disposed inside the hand grip shell 130, having two downward rods 1320 at two opposite ends respectively inserted through the through holes 1301 of the hand grip shell 130 and stopped at the push bars 114 of the retractable handle unit 11 at the top, a press knob 1322 on the middle at the top, and two through holes 1321 respectively spaced between the downward rods 1320 and the press knob 1322. The cover 131 is covered on the hand grip shell 130 over the pressure bar 132, having two downward female screws 1310 respectively inserted through the through holes 1321 of the pressure bar 132 and fixedly fastened to the hand grip shell 130 by screws.

Figure 4:
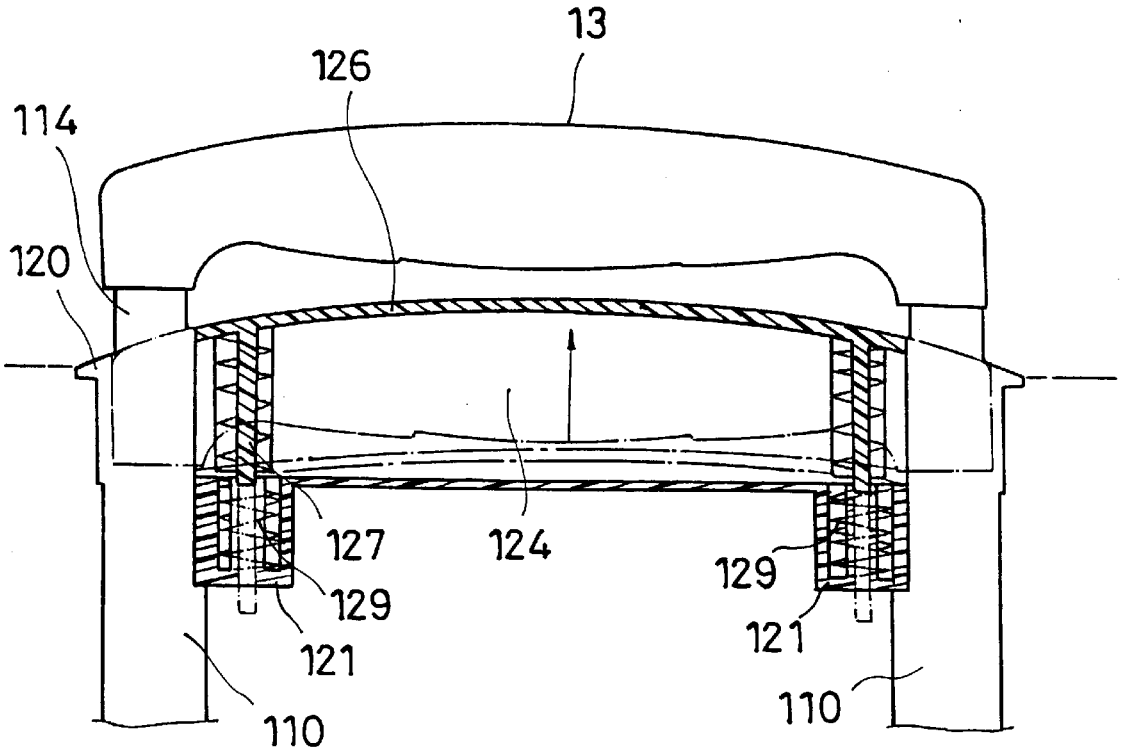
FIG. 4 is a schematic drawing showing the hand grip unit forced out of the control unit.
Figure 5:
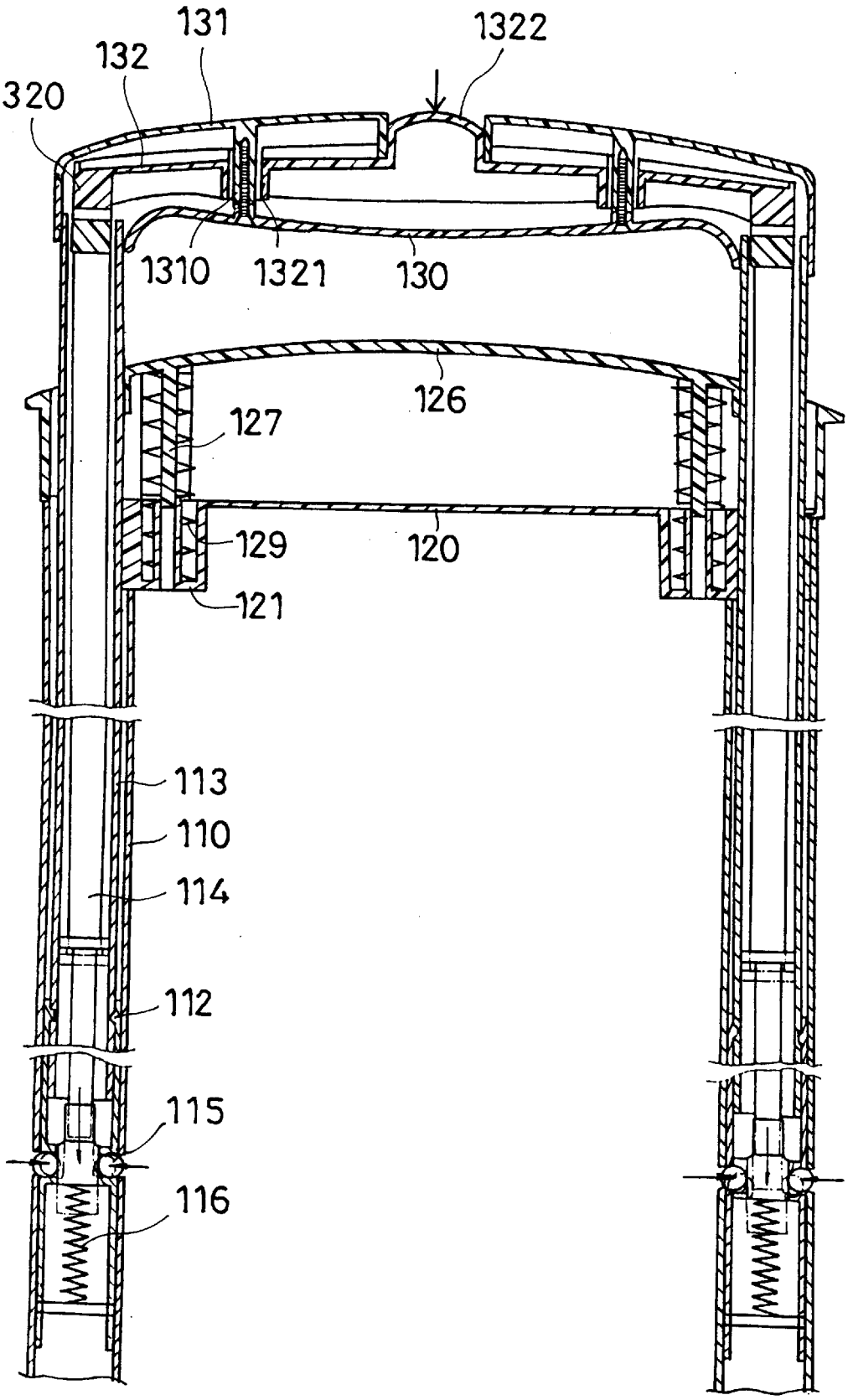
FIG. 5 is a sectional view of the present invention, showing the retractable handle operated.

The operation of the retractable handle control system is outlined hereinafter with reference to FIGS. from 3 to 5. When the control knob 122 is depressed, it is deformed, thereby causing its hooked portion 1221 to disengage from the locating flange 1302 of the hand grip shell 130, for permitting the cover plate 126 of the control unit 12 and the hand grip shell 130 of the hand grip unit 13 to be pushed upwards by the second springs 129 of the control unit 12. When the cover plate 126 is pushed upwards by the second springs 129, the downward hooks 128 are respectively hooked on the top edges of the sliding slots 123 of the casing 120 to limit the upward movement of the cover plate 126, permitting the cover plate 126 to be retained in flush with the top side of the casing 120, and at the same time, the hand grip shell 130 is lifted to a certain height outside the travel bag 10 for holding by hand (see FIGS. 3 and 4). After the hand grip shell 130 has been pushed out of the travel bag 10, the press knob 1322 of the pressure bar 132 which projects out of a hole on the cover 131 is pressed down. When the press knob 1322 of the pressure bar 132 is pressed down, the downward rods 1320 of the pressure bar 132 are forced downwardly against the push bars 114, causing the push bars 114 to be lowered in the sockets 112. When the push bars 114 are lowered, the steel balls 115 are released from the respective locating holes on the sleeves 110, permitting the sliding tubes 113 to be moved with the hand grip unit 13 to the extended position. When the sliding tubes 113 are moved to the extended position and the hand grip unit 13 is released from the hand, the steel balls 115 are forced into engagement with respective locating holes on the top ends of the sleeves 110. When to move the sliding tubes 113 from the extended position to the retracted position, the press knob 1322 is pressed down to release the steel balls 115 from the constrain of the respective locating holes on the top ends of the sleeves 110, and then the hand grip unit 13 is pressed down to lower the sliding tubes 113, permitting the hand grip unit 13 to be received in the top open chamber 124 of the casing 120 of the control unit 12. When the hand grip unit 13 is pushed into the top open chamber 124 of the casing 120 of the control unit 12, the locating flange 1302 of the hand grip shell 130 is forced into engagement with the hooked portion 1221 of the control knob 122, and at the same time the steel balls 115 are forced into engagement with the respective locating holes on the bottom end of the sleeves 110, and therefore the retractable handle is locked in the retracted position.

While only one embodiment of the present invention has been shown and described, it will be understood that various modifications and changes could be made thereunto without departing from the spirit and scope of the invention disclosed.

What the invention claimed is:

1. A retractable hand control system comprising a control unit fixedly mounted on a travel bag and coupled to a retractable handle unit in said travel bag, and a hand grip unit coupled to said retractable handle unit and controlled to move sliding tubes of said retractable handle unit in and out of said travel bag, wherein:

said control unit comprises a casing transversely fixed to said travel bag and coupled to said retractable handle unit, a movable cover plate, a cap, a first spring, and two second springs, said casing comprising two downward stub tubes adapted to receive the sliding tubes of said retractable handle unit, two spring holders respectively disposed adjacent to said downward stub tubes at an inner side, a resilient control knob on the middle, said resilient control knob and having a hooked portion for hooking up said hand grip unit, a top open chamber to receive said movable cover plate, and a plurality of vertical sliding slots spaced inside said top open chamber, said movable cover plate comprising a plurality of downward hooks respectively coupled to said vertical sliding slots to limit the movement of said movable cover plate vertically within said top open chamber, and two downward rods respectively inserted into the spring holders of said casing, said second springs being respectively mounted in the spring holders of the casing around the downward rods of said movable cover plate and adapted to impart an upward pressure to said movable cover plate, said cap being fastened to said casing at one side adjacent to said control knob, said first spring being stopped between said cap and said control knob;

said hand grip unit is comprised of a hand grip shell, a pressure bar, and a cover, said hand grip shell having two through holes at two opposite ends to hold the sliding tubes of said retractable handle unit, and a locating flange raised from a front side thereof on the middle for coupling to the hooked portion of said control knob of said casing, said pressure bar being disposed inside said hand grip shell, said pressure bar having two downward rods at two opposite ends respectively inserted through the through holes of said hand grip shell and stopped at a respective push bar in said sliding tubes of said retractable handle unit, a press knob on the middle at a top side, and two through holes, said cover of said hand grip unit being covered on said hand grip shell over said pressure bar, said cover of said hand grip unit having two downward female screws respectively inserted through the through holes of said pressure bar and fixedly fastened to said hand grip shell by screws;

said movable cover plate is pushed upwards by said first second springs to push hand grip unit out of said travel bag for holding by hand when the control knob of said casing is pressed to disengage the hooked portion of said control knob from the locating flange of said hand grip shell, for permitting said hand grip unit to be lifted to move said sliding tubes of said retractable handle unit to an extended position after the press knob of said pressure bar of said hand grip unit has been depressed to push down the push bars in said sliding sleeves.

* * * * *